United States Patent [19]

Blaese

[11] Patent Number: 5,023,622

[45] Date of Patent: Jun. 11, 1991

[54] ON-GLASS ANTENNA WITH CENTER-FED DIPOLE OPERATION

[76] Inventor: Herbert R. Blaese, 3314 Olcott Ave., Chicago, Ill. 60634

[21] Appl. No.: 535,281

[22] Filed: Jun. 7, 1990

Related U.S. Application Data

[63] Continuation of Ser. No. 379,179, Jul. 13, 1989, abandoned.

[51] Int. Cl.[5] ..... H01Q 1/320; H01Q 9/160

[52] U.S. Cl. ..... 343/715; 343/713; 343/793

[58] Field of Search ..... 343/713, 715, 900, 793, 343/794

[56] References Cited

U.S. PATENT DOCUMENTS

| | | | |
|---|---|---|---|
| 2,267,446 | 12/1941 | Cork, et al. | 333/12 |
| 4,658,259 | 4/1987 | Blaese | 343/715 |
| 4,764,773 | 8/1988 | Larsen et al. | 343/713 |
| 4,779,098 | 10/1988 | Blaese | 343/715 |
| 4,804,969 | 2/1989 | Blaese | 343/713 |
| 4,857,939 | 8/1989 | Shimazaki | 343/715 |
| 4,931,806 | 6/1990 | Wunderlich | 343/715 |
| 4,935,746 | 6/1990 | Wells | 343/715 |

FOREIGN PATENT DOCUMENTS

| | | | |
|---|---|---|---|
| 898012 | 11/1953 | Fed. Rep. of Germany . | |
| 1203227 | 1/1960 | France | 343/715 |
| 2141878 | 1/1985 | United Kingdom . | |

*Primary Examiner*—Michael C. Wimer
*Assistant Examiner*—Peter Toby Brown
*Attorney, Agent, or Firm*—Gerstman & Ellis, Ltd.

[57] ABSTRACT

An antenna for mounting on the window or the like comprises outer and inner RF transfer members, each having an electrically conductive member on its underside for respective engagement with the inside and outside of the window. A current-fed radiator is carried by the RF transfer member on the outside of the window, while the inner RF transfer member connects to electrical cable having both a main electrical conductor and a ground conductor. In accordance with this invention, counterpoise means comprises a conductor carried by the inner RF transfer member which is adapted for electrical engagement with a ground conductor. Typically, the elongated conductor is of about a quarter wavelength and is a coil. The counterpoise means typically extends in a direction which is at least generally in the direction of the current-fed radiator.

3 Claims, 1 Drawing Sheet

ON-GLASS ANTENNA WITH CENTER-FED DIPOLE OPERATION

This application is a continuation of U.S. application Ser. No. 379,179, filed July 13, 1988, now abandoned.

BACKGROUND OF THE INVENTION

The present invention relates to an improved antenna, which is typically either permanently or temporarily mounted on a window, or, alternatively, on another type of partition or the like.

Antennas for window mounting are well-known in the art being typically used on the windows of vehicles for cellular car telephones, being described, for example, in the Blaese, U.S. Pat. Nos. 4,658,259; 4,779,098; and 4,804,969.

In the first two of the patents previously cited, spaced, field-cancelling conductors are attached to the window, with the antenna being placed in electrical connection therewith to provide desired field cancelling effects. However, such an arrangement is undesirable, particularly in the case where a portable antenna is provided. There, the portable antenna may be carried by the user from car to car, being hung on a car window as described in the previously cited U.S. Pat. No. 4,804,969. In that patent, coiled wire field cancelling members are provided which project laterally outwardly from the antenna housing. Thus, the structure is somewhat bulky and cumbersome, and, while operating effectively, are relatively expensive to manufacture and to assemble into the antenna unit, so that improvements are desirable.

By this invention, an antenna for mounting on glass windows is provided in which field cancelling conductive tape does not have to be attached to the window, yet the antenna may be manufactured at reduced cost and with greater ease than the antenna of the last-cited patent. Additionally, the antenna of this invention is more compact than previous designs, while exhibiting great effectiveness in signal reception and transmission.

DESCRIPTION OF THE INVENTION

In this invention, an antenna is provided for mounting on a window or the like. The antenna comprises an outer RF (Radio Frequency) transfer member comprising a weather resistant carrier having a first electrically conductive member on its underside for engagement with the outside of the window. A current-fed radiator (antenna wire) is adopted to be located on the outside of the window and connected to the first electrically conductive member by connection with the weather resistant carrier.

An inner RF transfer member includes a housing which has a second electrically conductive member on its underside for engagement with the inside of the window. The housing also engages with an electrical cable having a main electrical conductor and a ground conductor, for example coaxial cable. The main electrical conductor is in electrical engagement with the second electrically conductive member.

In accordance with this invention, counterpoise means are provided which comprises an elongated conductor carried by the inner RF transfer member. The conductor is adapted for electrical engagement with the ground conductor. The conductor of the counterpoise means extends at least generally in the direction of the current-fed radiator.

Typically, the elongated conductor of the counterpoise means is of about a quarter wave in length, for most efficient operation in accordance with known principles of antenna design. It is also particularly preferred for the elongated conductor of the counterpoise means to be a coil, where the coil extends in the general direction of the current-fed radiator. Thus, the counterpoise means of the antenna may be a relatively short coil, typically about one to two inches in length or less, to provide a compact structure that is typically carried in downwardly projecting direction from the housing which holds the inner RF transfer member. Such a device can be more compact than the devices of the prior art, and may be easier to manufacture, so that the antenna in accordance with this invention may be either a permanent or a portable antenna, more compact than prior antennas, and easier and less expensive to manufacture.

Basically, the counterpoise means, typically being a coil, replaces the laterally projecting field cancelling members of the prior art, whether laterally projecting coiled wires or laterally projecting conductive tape. Preferably, the coil of this invention may be enclosed in a dielectric material for protection, for example plastic tape, or a plastic boot.

Basically, the antenna of this invention may be similar to the design of the previously cited U.S. Pat. No. 4,804,969, except as otherwise indicated herein.

DESCRIPTION OF SPECIFIC EMBODIMENT

Figure 1:
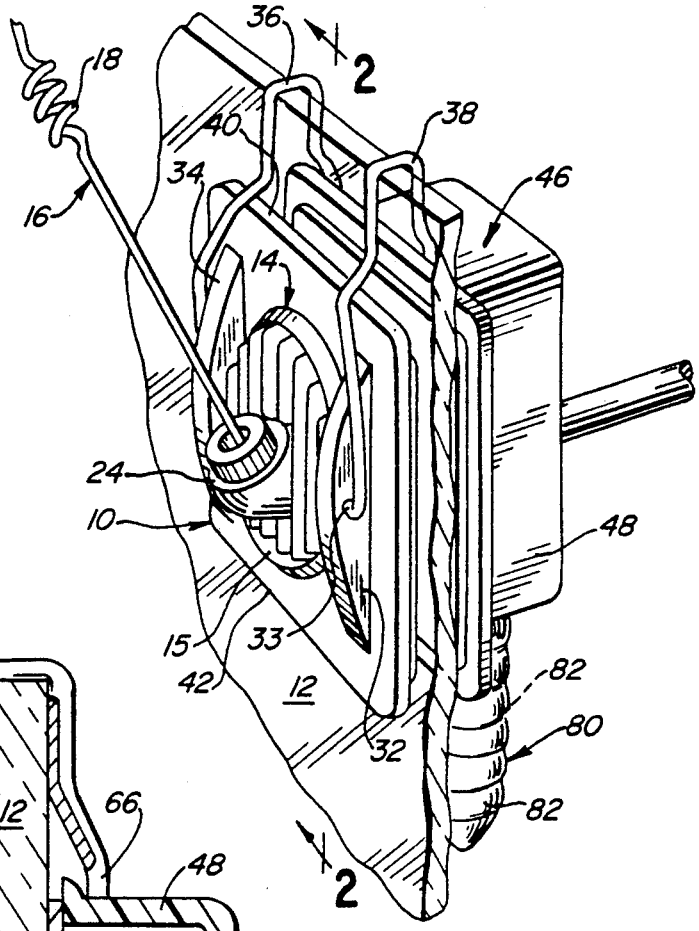
FIG. 1 is a perspective view of an antenna constructed in accordance with this invention.
Figure 2:
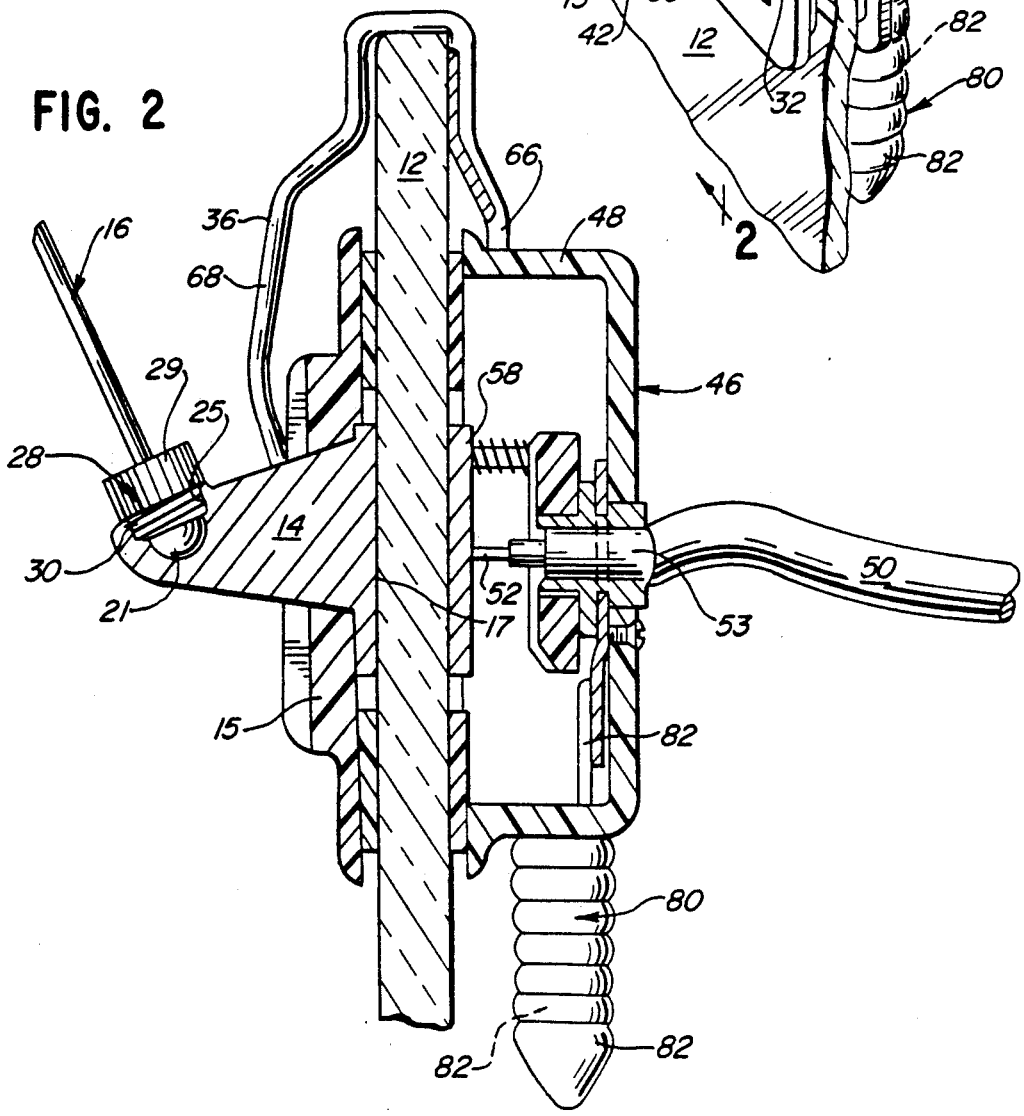
FIG. 2 is a cross-section taken along line 2—2 of FIG. 1.

Referring to the drawings, portable antenna 10 is adapted for mounting on the side window 12 of a motor vehicle. Antenna 10 comprises an outer RF transfer member 14 which includes a weather-resistant carrier 15 formed of a suitable plastic material having an electrically conductive plate 17 on its underside. In this manner, when outer RF transfer member 14 is positioned on the window as illustrated in FIGS. 1 and 2, electrically conductive plate 17 will be in engagement with the outside of window 12.

Antenna 10 includes a current-fed radiator 16. In this particular embodiment, radiator 16 may be a $\frac{5}{8}$ wavelength element stacked on a $\frac{3}{8}$ wavelength element with a phasing coil 18 separating the two elements to achieve gain. The proximal end 20 of radiator 16 may carry a mounting sphere in accordance with the teachings of U.S. Pat. No. 4,804,969, which is received within an internally threaded opening 25 defined by metal radiator mounting member 24, which member is carried by outer RF transfer member 14.

Mounting sphere 21 on the proximal end of radiator 16 is pivotable within an externally threaded metal nut member 28. Nut member 28 comprises a knurled ring 29 with a downward externally threaded portion 30, which threadedly engages the internally threaded mounting member. Accordingly, radiator 16 can be pivoted to any desired position. Once it is pivoted to such desired position, knurled ring may be tightened to drive sphere 21 tightly into the opening which carries it, effective locking sphere 21 and its radiator in place and providing good electrical contact between electrically conductive sphere 21 and member 24, which is in electrical contact with plate 17.

The weather-resistant carrier 15 of the outer RF transfer member 14 may define a pair of opposed journal members 32, 34, each of which carries a wire member 36, 38, which are of identical shape, and which may be made of a single, integral piece if desired. Each of the wire members extends into one of the holes 33, to enable outer transfer member 14 to pivot about the axes of holes 33 formed in each of journal members 32, 34, which are typically in coaxial relation. Holes 33 are located at the approximate midpoint between top end 40 of the outer transfer member 14 and bottom end 42, so as to enable the outer transfer member to pivot in a manner that is desirable for mounting. Thus, outer transfer member 14 may be carried on a window 12, with wire members 36, 38 extending over the top of the window for securance, as shown in both FIGS. 1 and 2.

Antenna 10 also comprises an inner RF transfer member 46, which includes a housing 48 preferably formed of a suitable plastic material. Inner transfer member 46 carries a second, electrically conductive plate 58 on its underside to engage the inside of window 12.

Antenna 12 is constructed so that electrical cable only need be provided on the inside of the motor vehicle. To this end, a conventional 50 ohm RF coaxial cable 50, having a central main conductor 52 and a concentric surrounding ground conductor 53, is connected to the inner transfer member 46.

A conventional connector, which is not shown, is provided at the other, distal end of cable 50 for connection to a cellular telephone transceiver or the like.

The central main conductor 52 is electrically connected to second electrically conductive plate 58.

In accordance with this invention, quarter wave coil 80 is carried by housing 48, with coil 80 extending in the direction which is at least generally in the direction of current fed radiator 16. Generally, the coil may deviate from parallel relationship with radiator 16 by up to about 45 degrees without significantly interfering with its functioning. Coil 80 comprises a coil of wire 82 of quarter wavelength, the wire 82 being connected to the concentric surrounding ground conductor 53 of coaxial cable 50, and serves as a counterpoise to radiator 16, extending in the direction generally opposite to that of the radiator, so that the structure in certain ways resembles a center-fed, dipole antenna with coil 80 representing one of the arms of the antenna.

The wire 82 of coil 80 may, if desired, be of the precise length of radiator 16. Also, wire 82 need not be in coil form, but may be stretched out in a manner opposite to that of radiator 16, if desired.

Because of the presence of coil 80, it is not necessary to provide field cancelling members as are found in previous embodiments of antennas, for example the antenna shown in U.S. Pat. No. 4,804,969.

It can be seen that outer transfer member 14 is pivotally connected to inner transfer member 46 by means of wire members 36 and 38. Each of the wire members is identical to the other wire member, and has a U-shaped portion which overlies the top of window 12, with a rear portion 66 that extends downwardly and is fastened to inner transfer member 46, in a manner shown in greater detail in the previously cited patent. Front portion 68 of each wire 36, 38 extends outwardly and downwardly to provide an inwardly spaced end portion that is received within one of holes 33 of the opposed journal members 32, 34. This permits pivoting of outer transfer member 14 as it is being mounted on window 12 to provide easy and rapid mounting.

Wire members 36 and 38 are formed of spring steel, and have a resilience so as to urge inner transfer member 46 and outer transfer member 14 toward each other, to provide an effective engagement of the respective electrical plates, 12, 16 against the respective sides of the window 12. In this manner, RF energy may be transferred through the window 12 without drilling of a hole.

Specifically, coil 80 may be about one inch in length. Coil 80 may be sheathed in a dielectric plastic boot 82 for protection of the wire inside the coil, for operation in the 825 to 890 mHz band. The coil may be proportioned to resonate at about an electrical quarter wavelength of the frequency of operation.

Accordingly, by this invention, an on-glass antenna is provided in which the usual, cumbersome field cancelling members which extend transversely to the radiator 16, have been replaced by a coil, or other counterpoise means, which extends generally in the direction of the current-fed radiator. This improvement results in a product which is less expensive and easier to manufacture, and which is less bulky and inconvenient to use than prior art structures. Thus, the antenna of this invention may be temporarily attached to a window as a less bulky unit, or it may be permanently attached by simple modifications, without the need for application of field-cancelling member conductive tape, as has been previously conventional.

The above has been offered for illustrative purposes only, and is not intended to limit the scope of the invention of this application, which is as defined in the claims below.

That which is claimed:

1. An antenna for mounting on a window, which comprises:

an outer RF transfer member comprising a weather-resistant carrier having a first electrically conductive member on its underside for engagement with the outside of said window;

a current-fed radiator adapted to be located on the outside of said window, said current-fed radiator having a proximal end and a distal end;

means connecting said proximal end of said current-fed radiator to said first electrically conductive member whereby said distal end of said current-fed radiator extends upwardly and outwardly when the antenna is mounted on a window;

an inner RF transfer member including a housing and having a second electrically conductive member on its underside for engagement with the inside of the window;

a coaxial electrical cable having a main electrical conductor and a ground conductor, said main electrical conductor being in electrical engagement with said second electrically conductive member;

said first electrically conductive member and said second electrically conductive member capacitively coupling said current-fed radiator to said main electrical conductor;

a conductive radiating element carried by said inner RF transfer member, said conductive radiating element having a proximal end and a distal end;

means connecting said proximal end of said conductive radiating element to said ground conductor, with said coaxial electrical cable extending generally between said proximal end of said current-fed radiator and said proximal end of said conductive radiating element with only said main electrical conductor being capacitively coupled to said current-fed radiator;

said ground conductor being located only on the inside of said window and not being capacitively coupled to said current-fed radiator;

said distal end of said conducive radiating element extending generally in the opposite direction from said distal end of said current-fed radiator, whereby said antenna resembles a center-fed dipole antenna with said conductive radiating element representing one of the radiating arms of the antenna and also substituting as a ground plane.

2. An antenna as defined in claim 1, in which said current-fed radiator is about one-quarter wavelength of the operating frequency of the antenna and said conductive radiating element is about one-quarter wavelength of said operating frequency.

3. An antenna as described in claim 2, in which said conductive radiating element is coiled.

* * * * *